US006114665A

United States Patent [19]

Garcia et al.

[11] Patent Number: 6,114,665

[45] Date of Patent: Sep. 5, 2000

[54] OVEN WITH SELF-HEATED COOKING-PRODUCT SUPPORT

[75] Inventors: Jose Andres Garcia, Saragossa, Spain; Joachim Reichard, Starnberg, Germany; Felicitas Ziegler, Stein, Germany; Manfred Plankl, Traunreut, Germany; Hans Lappat, Garching/Alz, Germany; Armin Sigmund, Traunreut, Germany; Bernd Stitzl, Lauter, Germany; Michael Wagner, Grabenstätt, Germany; Kurt Knebel, Traunreut, Germany; Klaus Erdmann, Bretten, Germany; Hans Linde, Coburg, Germany; Uwe Neumann, Bamberg, Germany; Andreas Rehklau, Freising, Germany

[73] Assignee: BSH Bosch und Siemens Hausgeraete GmbH, Munich, Germany

[21] Appl. No.: 09/344,923

[22] Filed: Jun. 28, 1999

[30] Foreign Application Priority Data

Jun. 26, 1998 [DE] Germany ..... 198 28 640

[51] Int. Cl.[7] ..... A21B 1/02; A21B 1/22; H05B 3/06; H05B 3/22; H05B 3/30

[52] U.S. Cl. ..... 219/404; 219/403; 219/395; 219/536; 219/541; 126/337 R; 126/339; 126/333

[58] Field of Search ..... 219/395, 403, 219/404, 507, 536, 541; 126/332, 333, 337 R, 339

[56] References Cited

U.S. PATENT DOCUMENTS

| | | | |
|---|---|---|---|
| 2,994,760 | 8/1961 | Pecoraro et al. | 219/395 |
| 3,146,338 | 8/1964 | Seremak | 219/403 |
| 3,674,982 | 7/1972 | Hoyt et al. | 219/403 |
| 3,924,100 | 12/1975 | Mack et al. | 219/403 |
| 4,780,597 | 10/1988 | Linhart et al. | 219/404 |
| 5,618,458 | 4/1997 | Thomas | 219/403 |
| 5,720,273 | 2/1998 | Trullas | 126/19 R |
| 5,994,673 | 11/1999 | El-Shoubary et al. | 219/403 |

FOREIGN PATENT DOCUMENTS

| | | |
|---|---|---|
| 28 22 085 C2 | 9/1982 | Germany . |
| 40 23 949 A1 | 8/1991 | Germany . |
| 42 36 740 A1 | 5/1994 | Germany . |
| 42 43 364 A1 | 6/1994 | Germany . |

*Primary Examiner*—Joseph Pelham
*Attorney, Agent, or Firm*—Herbert L. Lerner; Laurence A. Greenberg; Werner H. Stemer

[57] ABSTRACT

An electric oven with an oven muffle which can be closed by a door and in which a cooking-product support can be held on a holder element. The cooking-product support has its own cooking-product support heater element, and via a power supply element, the cooking-product support heater element can be fed with an electric voltage of the oven, is known. In order to keep the outlay for providing electrical contact for the cooking-product support heater element low, the holder element for the cooking-product support at the same time serves as the power supply conduit or element.

6 Claims, 1 Drawing Sheet

OVEN WITH SELF-HEATED COOKING-PRODUCT SUPPORT

BACKGROUND OF THE INVENTION

FIELD OF THE INVENTION

The present invention relates to an electric oven with an oven muffle that can be closed by a door and in which a cooking-product support can be held on a holder element. The cooking-product support has its own cooking-product support heater element, and via a power supply element, with which the cooking-product support heater element can be fed with an electric voltage of the oven.

An electric oven of this nature is known from German Utility Model G 85 32 629.1, in which the cooking-product support can be pushed in at various levels on lateral guides in the oven muffle. Electric sockets are provided in the rear wall of the oven muffle at each of the different levels that correspond to those of the lateral guides. The heater device for the cooking-product support contains a sheet-type heater element that is disposed on the underside of the cooking-product support base.

SUMMARY OF THE INVENTION

It is accordingly an object of the invention to provide an oven with a self-heated cooking-product support, which overcomes the above-mentioned disadvantages of the prior art devices of this general type, in which the outlay for providing the electrical contact for the cooking-product support heater element in an electric oven is reduced.

With the foregoing and other objects in view there is provided, in accordance with the invention, an electric oven, including:

an oven muffle defining a cooking space;

a door having an interior surface for closing the oven muffle;

a holder element disposed in the cooking space; and a cooking-product support supported by the holder element, the cooking-product support having a cooking-product support heater element receiving an electric voltage, the holder element serving as a power supply conduit for delivering the electric voltage to the cooking-product support heater element.

According to the invention, the holder element for the cooking-product support serves at the same time as the power supply conduit or element for the cooking-product support heater element. The integration of both the holder function and the power supply function in a single element simplifies the structure of the electric oven.

By way of example, known suspension grates or supporting frames, are disclosed, for example, in Published, Non-Prosecuted German Patent Application DE 42 43 364 A1. The patent discloses frame carriages which are guided displaceably within the cooking space, such as those which are disclosed, for example, in Published, Non-Prosecuted German Patent Application DE 42 36 740 A1, and the grooves of grooved ovens which are known per se may be configured in accordance with the invention. The two metal supporting frames which are suspended from opposite side walls of the oven muffle project out of the muffle wall, for example by contact end sections which pass through corresponding openings in the muffle wall. The contact end sections of the supporting frames are connected to the supply voltage of the oven. At the same time, the supporting frame is electrically insulated from the muffle wall. The self-heated cooking-product support that can be pushed in at various levels rests, with its own weight plus that of the cooking product, on, for example, the guide rods of the metal supporting frame. The cooking-product support heater element is connected to the electrical supply voltage of the oven by contact with the metal supporting frame via suitable connecting points of the heater element.

Alternatively, it is also possible for a metal frame carriage to have, for example, a pair of plugs disposed on the two side areas of the carriage on its end section that faces the rear wall. When the frame carriage is pushed into the muffle, the pair of plugs are plugged into a pair of electric sockets which are provided on the rear wall of the oven muffle and are connected to mains voltage. The important factor here is for the left-hand part of the frame carriage to be electrically insulated from the right-hand part, in order to prevent short-circuiting of the supply voltage through the frame carriage. When a cooking-product support is inserted into the frame carriage, the cooking-product support heater element is connected to the supply voltage that is present at the frame carriage and the relevant safety regulations are observed.

Furthermore, it is also possible to provide electrically conductive contact surfaces on the grooves which are formed in the side walls of an oven muffle and which serve to guide and hold cooking-product supports on both sides in a manner known per se. When, for example, a baking sheet is pushed into the mutually opposite grooves of the muffle, the contact points of the cooking-product support heater element are pressed onto the corresponding contact points of the grooves in particular by the weight of the cooking-product support which has been increased by that of the cooking product. The contact points of the grooves are insulated from the muffle wall and are connected to the electric voltage of the oven. As a result, the cooking-product support heater element is connected to the supply voltage of the oven.

It is particularly simple, in construction terms, if two hook rails, which are known in ovens with sliding cooking drawers, are provided as the holder element. In particular, it is advantageous in this case that it is simple to electrically insulate the hook rails from the oven and that, as a result of the cooking-product support being suspended from the hook rails, the resultant torques ensure that the pressure forces are high and therefore that there is reliable contact between the connection elements of the cooking-product support heater element and the hook rails to which the electric voltage is applied.

The cooking product or the cooking-product support is particularly accessible if the holder element is attached to the inside of the oven door. Furthermore, this allows its function or electrical safety to be tested in a particularly simple manner. As an alternative, it is possible, for example, for the two hook rails to be held on an air baffle which, in electric ovens which operate using circulating air, is disposed in a manner known per se in the area of the rear wall of the muffle. In order to make the cooking product or the cooking-product support more accessible, the air baffle is guided displaceably in the muffle in the manner of a frame carriage.

To increase the electrical safety, the oven has a door switch and an operating switch, which together lie in the power supply circuit of the power supply element. Only when the operating switch is actuated and, at the same time, the door of the oven is closed correctly is voltage applied to the is holder element. Consequently, there is no possibility of direct contact between a user and parts to which electric voltage is applied.

Other features which are considered as characteristic for the invention are set forth in the appended claims.

Although the invention is illustrated and described herein as embodied in an oven with a self-heated cooking-product support, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
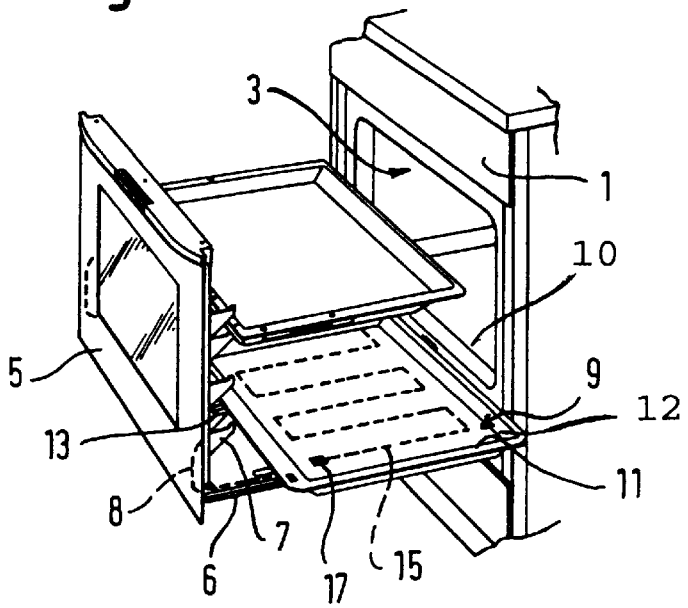
FIG. 1 is a perspective view of parts of an oven of a first exemplary embodiment according to the invention.

In all the figures of the drawing, sub-features and integral parts that correspond to one another bear the same reference symbol in each case. Referring now to the figures of the drawing in detail and first, particularly, to FIG. 1 thereof, there is shown a first exemplary embodiment of an electric oven 1 with a quadruple cooking space 3 defined by an oven muffle 10 that can be closed off at the front by an oven door 5. In this case, the oven door 5 is configured in the form of a displaceable sliding cooking draw. A front panel, which is known per se, of the oven door 5, together with a door handle, is attached to a metal door base which is known per se. A pair of horizontal slides 6 are rigidly connected to a lower end section of the oven door 5. Each of the slides 6 is configured in accordance with the disclosure of Published, Non-Prosecuted German Patent Application DE 40 23 949 A1 and is guided in the oven 1 in a manner known per se. A metal hook rail 7 is attached to an inside of the oven door 5 on both side sections. The hook rail 7 extends over substantially an entire height of the oven door 5 and, in the exemplary embodiment in accordance with FIG. 1, has four hooks which lie above one another. The hook rails 7 are electrically insulated from the oven door 5 and are connected to a non-illustrated supply voltage of the oven 1 via electric lines 8 (dashed line) which are guided inside or beneath the door 5. For cooking purposes, baking sheets 9 having a frame 12 can be placed into the cooking space 3. A flange 11 of the baking sheet 9 is placed onto a metal supporting frame 13. The supporting frame 13 is suspended in the two hook rails 7 in such a manner that it forms a stable bearing which extends horizontally in the form of a frame. In addition, the two side areas of the supporting frame 13 are electrically insulated from one another, in order to prevent short-circuiting of the supply voltage through the supporting frame 13. Due to the mechanical connection to the hook rails 7, the supporting frame 13, for safety reasons, can only be connected to the supply voltage of the oven 1 when the oven door 5 is closed and, at the same time, when the oven 1 is switched on. By placing the baking sheet 9 onto the supporting frame 13, it is furthermore possible to connect a meandering thick-film heater element 15, which has been applied to the underside of the baking sheet 9 and is illustrated in dashed lines, to the supply voltage. The heating current flows through the lines 8, via the hook rails 7, to the supporting frame 13 and, via suitable contact pads 17 of the heater element 15, to the latter (FIG. 1).

Figure 2:
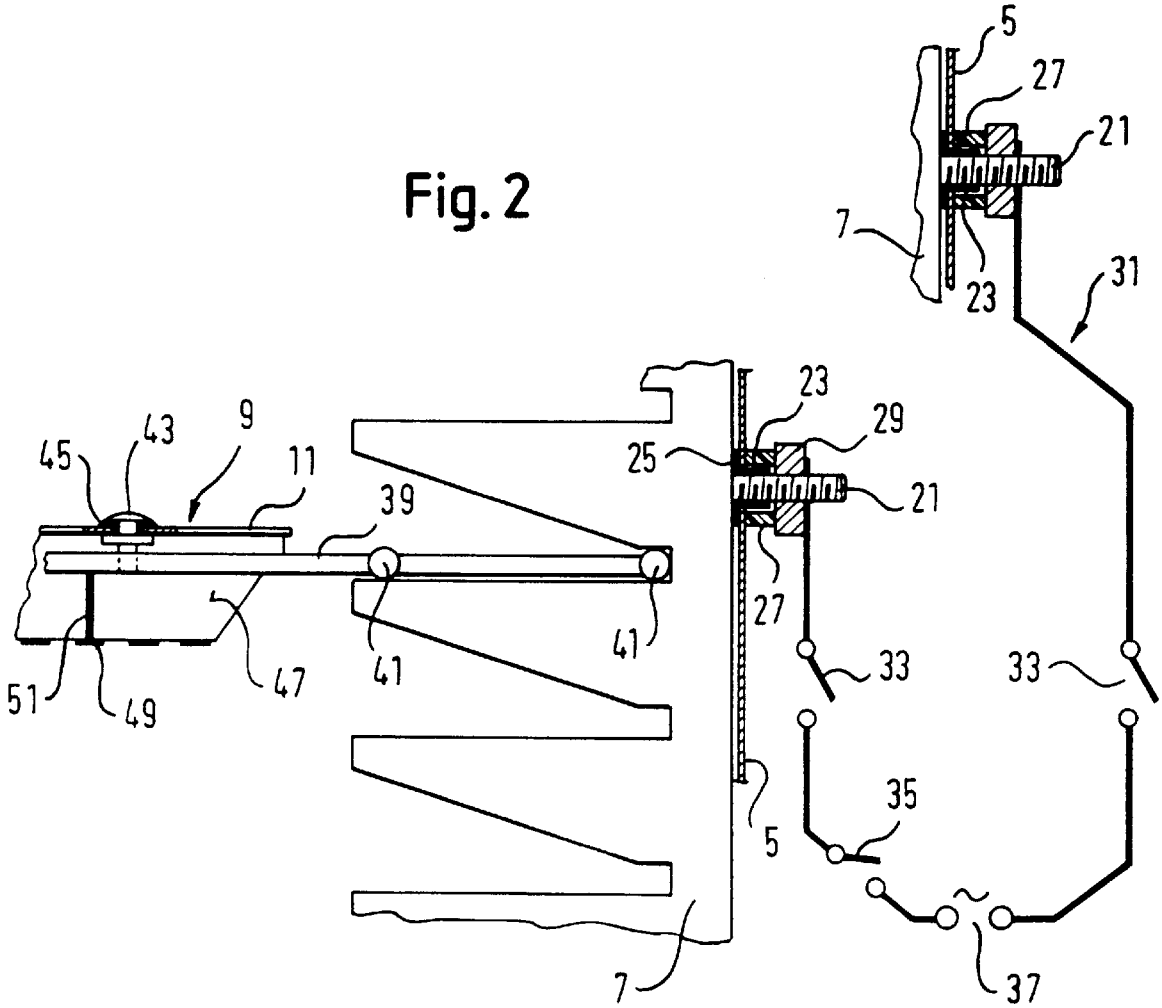
FIG. 2 is an enlarged, fragmented, sectional view of a considerably simplified part of a second exemplary embodiment.

For reasons of simplicity, in the second exemplary embodiment illustrated in FIG. 2 the reference numerals from the first exemplary embodiment illustrated in FIG. 1 have been transferred without change. Also for reasons of simplicity, FIG. 2 only illustrates sections of the hook rails 7 which are attached to the door 5 and the cooking-product support 9. In particular, the oven door 5, which is configured in the form of a sliding cooking drawer in accordance with the first exemplary embodiment, is illustrated in highly diagrammatic form. To attach the baking sheet 9 to the inside of the oven door 5, a threaded pin 21 is welded to the hook rail 7. The pin 21 is inserted through a suitable opening in the door 5 and is electrically insulated from the door 5 by a first insulation sleeve 23. The first insulation sleeve 23 also has a sleeve flange 25, so that the door 5 is also electrically insulated from the hook rail 7. With the aid of a second insulation sleeve 27, a nut 29, which is used to attach the hook rail 7 to the door 5, is also electrically insulated from the door 5. The two threaded pins 21 form the electrical contact points for a consumer, described below, of an electric circuit 31. In the circuit 31, there are two door switches 33 which, when the door 5 is open, disconnect all poles of the power supply for the threaded pins 21. Furthermore, a circuit-breaker 35 of the oven 1 is connected in series with the two door switches 33. The electric circuit 31 is supplied by a mains connection 37 of the oven 1. The threaded pins 21 and therefore the hook rails 7 are thus not connected to mains voltage 37 when the door 5 is slightly open. The voltage supply is also interrupted when the circuit-breaker or operating switch 35 is still in its off position. However, if an oven operating mode has been selected and an operating temperature has been set, and the oven door 5 is securely closed, the two hook rails 7 are connected to the mains voltage 37 and are insulated from one another.

The enameled baking sheet 9 has metal support parts 39 that are attached to both of its side sections. The contact points, which are configured as bead-like bearing attachments 41, of each of the support parts 39 rest securely in the hook rail 7 due to the torque that is produced and therefore also produce a secure electrical contact. The support 39 is stably attached to the baking-sheet flange 11 in each case by two rivets 43 that are spaced apart from one another. In order to achieve reliable insulation of the baking sheet 9 from the electric circuit, an insulation disk 45 and a sufficiently thick layer of enamel 47 which covers the surface of the baking sheet 9 on all sides are provided. On the bottom of the baking sheet 9, a heating conductor 49 is formed over a large surface area of the layer of enamel 47 by thick-film technology, which conductor is connected to the two supports 39 of the baking sheet 9 and therefore to the mains voltage 37 by a power supply line 51.

We claim:

1. An electric oven, comprising:

an oven muffle defining a cooking space;

a door having an interior surface for closing said oven muffle;

a holder element disposed in said cooking space; and a cooking-product support supported by said holder element, said cooking-product support having a cooking-product support heater element receiving an electric voltage, said holder element serving as a power supply conduit for delivering the electric voltage to said cooking-product support heater element.

2. The electric oven according to claim 1, wherein said holder element is two hook rails.

3. The electric oven according to claim 1, wherein said holder element is attached to said interior surface of said door.

4. The electric oven according to claim 1, including a door switch and an operating switch both lying in a power supply circuit feeding the electric voltage to said holder element functioning as said power supply conduit.

5. A cooking-product support, comprising:

a frame;

a cooking-product support heater element disposed on said frame; and a support part extending from said frame for connecting to a holder element of an electric oven for supporting said frame, said support part connected in an electrically conductive manner to said cooking-product support element.

6. A baking sheet, comprising, a frame;

a cooking-product support heater element disposed on said frame; and a support part extending from said frame for connecting to a holder element of an electric oven for supporting said frame, said support part connected in an electrically conductive manner to said cooking-product support element.

* * * * *